US007392863B2

(12) United States Patent
Björk

(10) Patent No.: US 7,392,863 B2
(45) Date of Patent: Jul. 1, 2008

(54) ROCK DRILL BIT

(75) Inventor: Fredrik Björk, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 3 days.

(21) Appl. No.: 10/569,198

(22) PCT Filed: Nov. 10, 2004

(86) PCT No.: PCT/SE2004/001628

§ 371 (c)(1),
(2), (4) Date: Nov. 17, 2006

(87) PCT Pub. No.: WO2005/056972

PCT Pub. Date: Jun. 23, 2005

(65) Prior Publication Data

US 2007/0137900 A1 Jun. 21, 2007

(30) Foreign Application Priority Data

Dec. 9, 2003 (SE) ..... 0303316

(51) Int. Cl.
*E21B 10/36* (2006.01)

(52) U.S. Cl. ..... 175/414; 175/417

(58) Field of Classification Search ..... 175/393, 175/417

See application file for complete search history.

(56) References Cited

U.S. PATENT DOCUMENTS

| | | | | |
|---|---|---|---|---|
| 3,955,635 | A | 5/1976 | Skidmore | |
| 4,299,298 | A * | 11/1981 | McEnery et al. | 175/418 |
| 4,598,779 | A | 7/1986 | Liljekvist et al. | |
| 4,819,756 | A * | 4/1989 | Krude | 180/360 |
| 4,940,097 | A * | 7/1990 | Martini | 175/296 |
| 5,029,657 | A * | 7/1991 | Mahar et al. | 175/393 |
| 5,595,252 | A * | 1/1997 | O'Hanlon | 175/57 |
| 5,794,728 | A | 8/1998 | Palmberg | |
| 5,890,551 | A | 4/1999 | Liljebrand et al. | |
| 2004/0065482 | A1 | 4/2004 | Larsson | |

FOREIGN PATENT DOCUMENTS

| | | |
|---|---|---|
| SE | 520036 | 5/2003 |

* cited by examiner

*Primary Examiner*—Frank S Tsay
(74) *Attorney, Agent, or Firm*—Drinker Biddle & Reath LLP

(57) ABSTRACT

The present invention relates to a rock drill bit for percussive drilling. The drill bit comprises a bit body; a head portion defining a longitudinal center axis. The head portion comprises a front face having an outer surface portion, and an inner surface portion disposed radially inside of the outer surface portion. The inner surface portion is partially recessed by a cavity with respect to the outer surface portion. A plurality of fluid channels extends through the head portion and communicates with the cavity for conducting a flushing medium thereto. The inner surface portion comprises a raised portion carrying a plurality of buttons. An imaginary circle intersects centers of the fluid channels and also intersects an equal number of buttons.

19 Claims, 3 Drawing Sheets

ROCK DRILL BIT

TECHNICAL FIELD OF THE INVENTION

The present invention relates to a rock drill bit for percussive drilling, especially top hammer drilling, according to the preamble of the independent claim.

Through U.S. Pat. No. 5,890,551 a rock drill bit is previously known, which has an appurtenant drill rod. The rock drill bit at the front face thereof is provided with cemented carbide buttons that work the rock by impacting thereupon during simultaneous rotation. A cavity is formed in the front face, and a fluid channel extends through the drill bit for supplying flushing fluid to the cavity. The cavity is completely bordered by an endless land. Some of the buttons are mounted in the land. Others of the buttons are mounted in the cavity in order to be cooled and flushed by a cushion of flushing fluid created in the cavity. In some cases the drill bit channels have been clogged by debris.

OBJECTS OF THE INVENTION

The present invention has the object of providing a rock drill bit of the kind defined in the introduction, with extended service life.

Another object of the present invention is to provide a rock drill bit that permits good rock removal.

Still another object of the present invention is to provide a rock drill bit with efficient flushing.

Still another object of the present invention is to provide a rock drill bit that is more easily reground.

Still another object of the present invention is to provide a rock drill bit having fluid channels not easily be clogged or deformed.

Still another object of the present invention is to provide a rock drill bit suitable for left hand and right hand drilling.

The objects of the present invention are realized by means of a rock drill bit having the features defined in the characterizing portions of the appended independent claims.

BRIEF DESCRIPTION OF THE DRAWINGS

An embodiment of the rock drill bit according to the present invention will be described below, references being made to the accompanying drawings, wherein.

DETAILED DESCRIPTION OF A PREFERRED EMBODIMENT OF A ROCK DRILL BIT ACCORDING TO THE PRESENT INVENTION

Figure 1A:
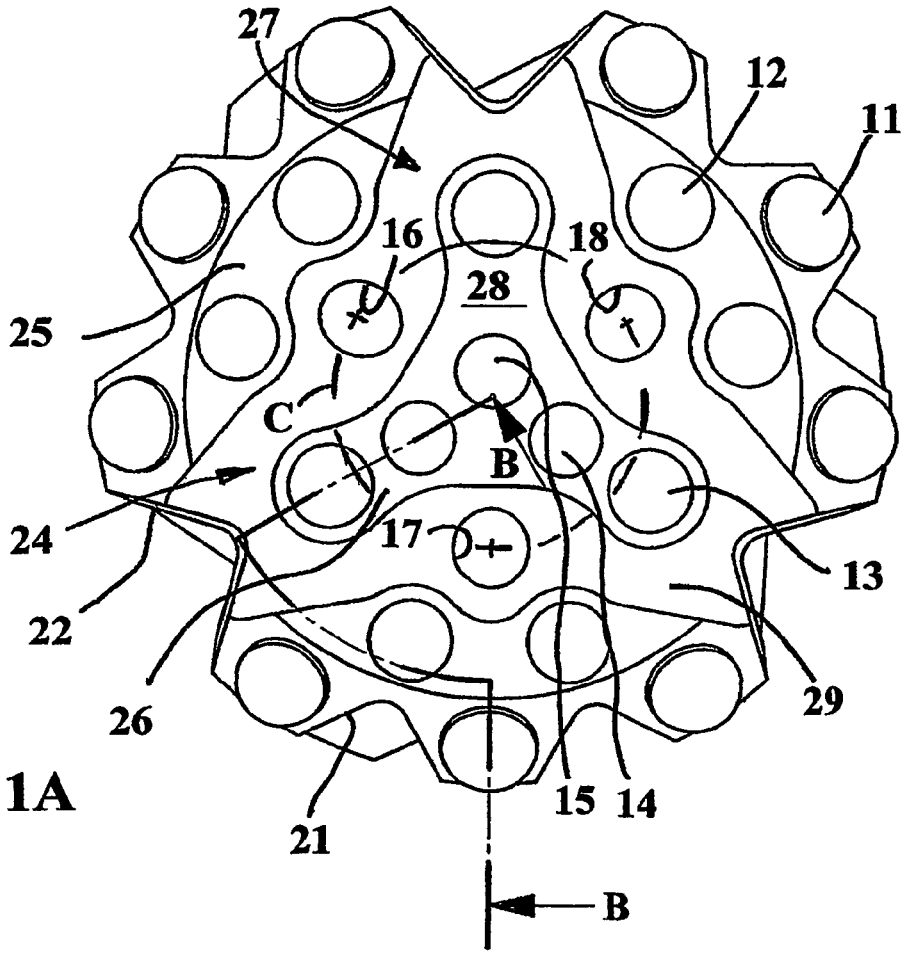
FIG. 1A shows a front view of a rock drill bit according to the present invention.
Figure 1B:
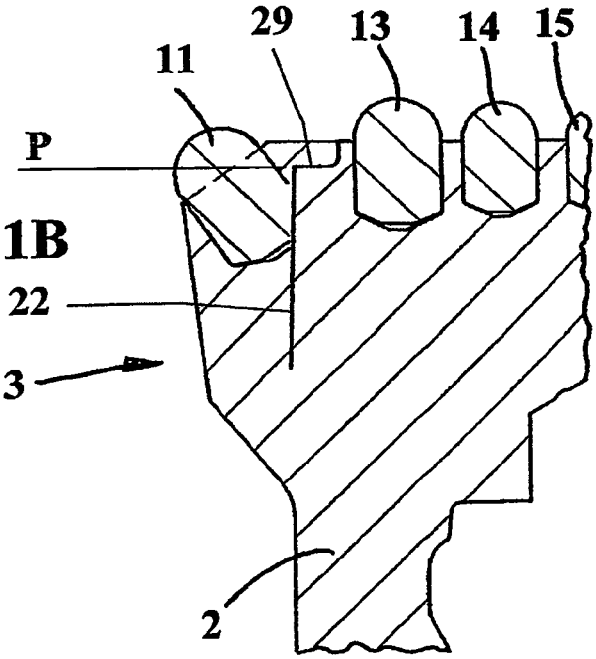
FIG. 1B shows a cross-section through the rock drill bit according to line B-B in FIG. 1A.
Figure 2:
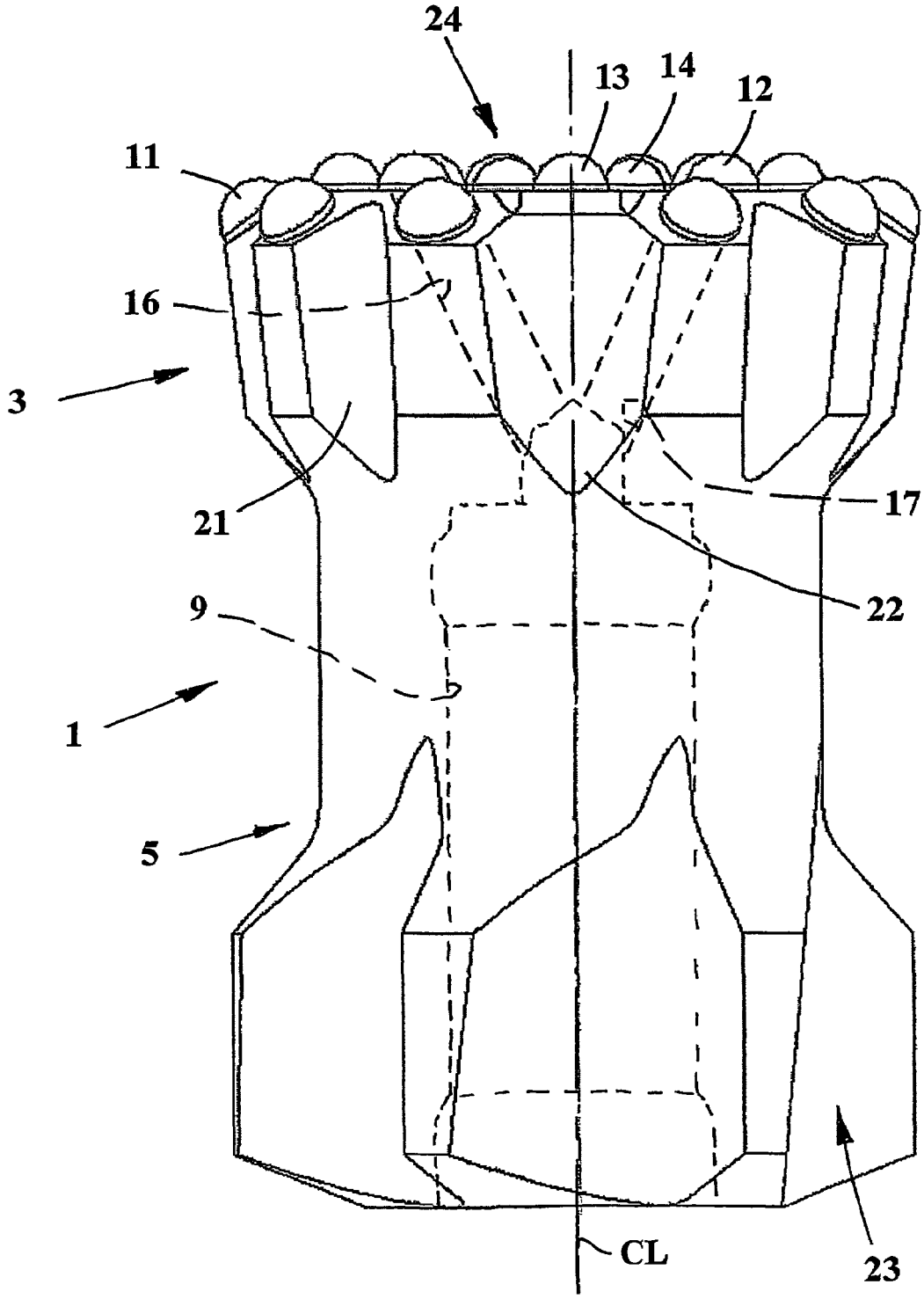
FIG. 2 shows a side view of the rock drill bit.
Figure 3:
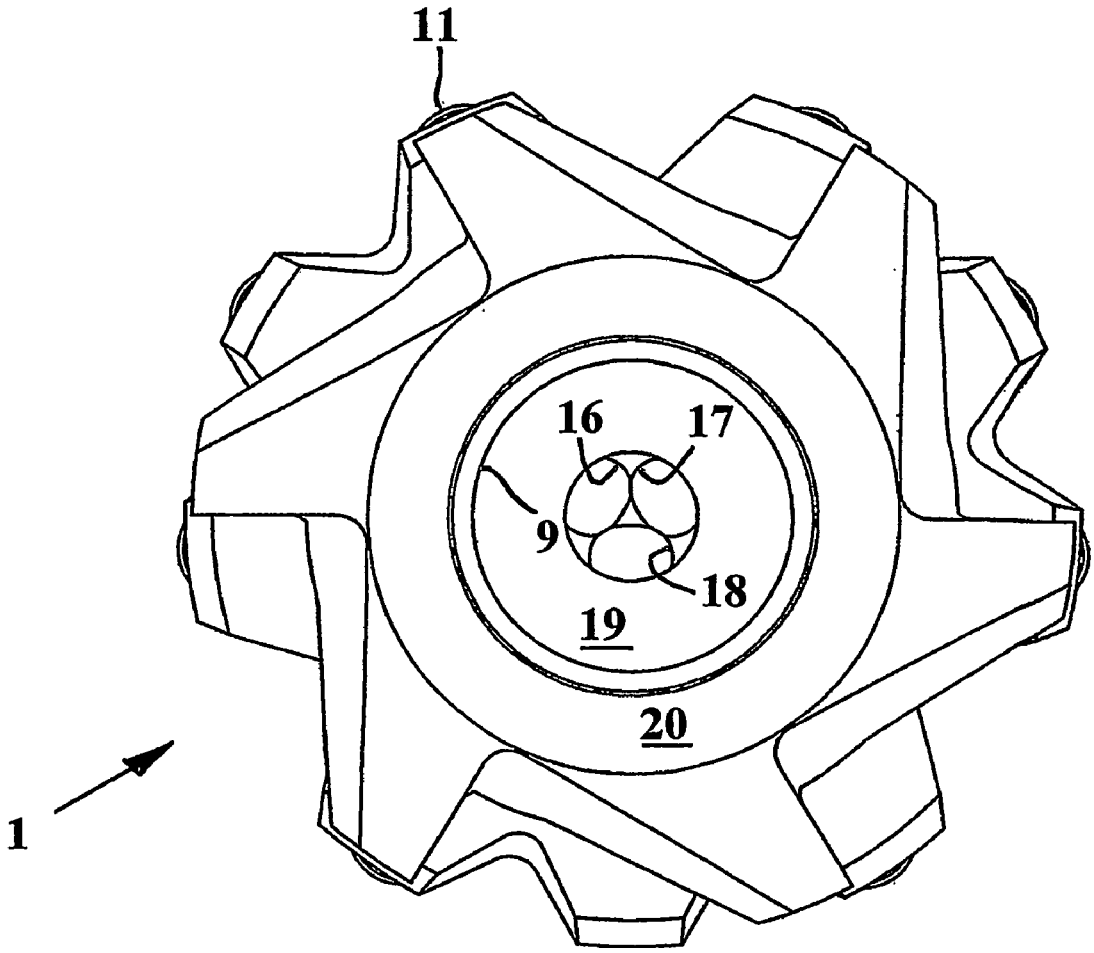
FIG. 3 shows a rear view of the rock drill bit.

The rock drill bit 1 illustrated in FIGS. 1-3 comprises a bit body 2 having a drill head 3 and a shank or a skirt 5. The drill head 3 and the skirt 5 are integrated with each other. A drill rod, not shown, is supposed to be connected to the rock drill bit 1 via a thread coupling. In the drill rod, a through-going flush duct is arranged in the conventional way. A longitudinal centre axis CL of the rock drill bit 1 is drawn in FIG. 2.

As is most clearly is seen in FIG. 2, the rock drill bit 1 is provided with an internal female thread 9 supposed to receive an external male thread at one end of the drill rod.

The drill head 3 of the rock drill bit 1 according to the present invention is provided with rock removing members in the form of cemented carbide buttons 11, 12, 13, 14 and 15. A number of cooling medium channels 16, 17 and 18 extends between the internal space of the rock drill bit 1, which is defined between the internal female thread 9, and the front face of the drill head 3. In said internal space, a first stop face 19, a so-called bottom stop, is also arranged for the free end of the drill rod.

At the rear end of the rock drill bit 1, as is most clearly shown in FIG. 3, a second stop face 20, a so-called shoulder stop, is arranged, which is intended to interact with a shoulder of the drill rod, with a so-called shoulder-bottom stop. That means that the drill rod is manufactured with such tolerances that, at establishment of the threaded joint between the rock drill bit 1 and the drill rod, the free end of the drill rod initially will come to abutment against the bottom stop 19. After a relatively short time of wearing-in of the threaded coupling, also the shoulder of the drill rod comes into abutment against the shoulder stop 20, i.e. abutment between the rock drill bit 1 and the drill rod takes place at both the bottom stop 19 and the shoulder stop 20. This means that transfer of shock wave energy from the drill rod to the rock drill bit 1 will be effected via both the bottom stop and the shoulder stop.

As is most clearly seen in FIGS. 1A and 2, the rock drill bit 1 is on the outside thereof provided with a number of straight, front 21, 22 and rear 23 peripheral grooves for cuttings extending in the axial direction of the rock drill bit 1. Each front groove for cuttings 21, 22 is symmetrically arranged in relation to a line parallel with the centre axis 2. The front grooves 21, 22 are provided between each pair of peripheral buttons 11 in the bit body. Nine peripheral buttons 11 are mounted in the front face 24 of the drill bit. Each button is tilted relative to the centre axis CL. The diameter of the peripheral button is relatively large. The peripheral buttons 11 are arranged in three segments, i.e. three peripheral buttons in each segment. Each segment is spaced in the wreath of peripheral buttons from another adjacent segment by a front groove 22, the depth and width of which is greater than the corresponding measures of the front groove 21. The front groove 21 is arranged between two peripheral buttons in the segment. The grooves 21, 22 allow passage for cuttings from the front face. Each rear groove 23 for cuttings is asymmetrically arranged in relation to a line parallel with the centre axis. Each rear groove 23 for cuttings consists of a first chip surface and a second chip surface, which are substantially perpendicular to each other. The geometry of the rear end of the drill bit is more closely described in SE-C2-520036, the disclosure of which is incorporated into the present description. Retrac teeth are positioned at the maximum diameter of the drill bit, as well as inside of the same, at the end generally facing away from the rock removing end of the rock drill bit. The purpose of the rear end of the drill bit is to make sure that guiding of the drill bit 1 in the bore hole is carried out by means of the portions that are located in connection with the ends of the rock drill bit 1, and to decrease the resistance against the release of cutting dust. The grooves for cuttings 21, 22, 23 are intended to transport away the drill dust produced at the front of the rock drill bit 1.

The head portion 3 comprises a front face 24 having an outer surface portion 25, and an inner surface portion 26 disposed radially inside of the outer surface portion. The inner surface portion is partially recessed with respect to the outer surface portion 25 by means of a cavity. The cavity 27 surrounds a raised portion 28 and is formed by three grooves 29, each opening into the larger groove 22 for cuttings. Preferably, each groove 29 is milled to produce a bottom and shoulders. These shoulders end close to peripheral buttons at each side of the deepest part of the groove 22.

Six front buttons 12 are mounted in the front face in the outer surface portion 25 radially inside of the wreath of peripheral buttons 11 but mounted radially outside of the circle (C). The diameter of each button 12 is smaller than the diameter of the peripheral button. The buttons 12 are arranged in pairs at a location inside the segments, i.e. two buttons close to each segment.

The raised portion 28 comprises at least five, preferably six, front buttons 13, 14 and 15, whereof a more central button 15 is intersected by the longitudinal center axis CL. The raised portion 28 is of generally triangular shape having rounded corner portions comprising buttons 13 and a planar upper surface. The diameter of each button 13, 14 and 15 is smaller than the diameter of the peripheral button 11. Preferably, the diameters of the button 14 and 15 are equal and smaller than the diameter of the button 13. In the raised portion two intermediate buttons 14 are arranged between the central button 15 and two of the buttons 13.

An imaginary circle C intersects the centres of the fluid channels 16, 17 and 18 and also intersects an equal number of the buttons 13, i.e. the three buttons 13. The six front buttons 13, 14 and 15 are mounted in the front face radially outside of the circle C. The nine peripheral buttons 11 are mounted in the front face radially outside of the circle C. The circle C can be concentric with the axis CL of the drill bit.

The three fluid channels 16-18 communicate with the cavity for conducting a flushing medium thereto. The orifices of the fluid channels are positioned centrally between two front grooves 22, i.e. at the midarea of a line intersecting two grooves 22. The orifices of the fluid channels are arranged in one plane P below the raised portion 28. Preferably, the cavity 27 extends somewhat in between each pair of buttons 12. A line, such as the radially inner part of section B-B in FIG. 1A, simultaneously intersects the midpart of the groove 22, the center axis CL and the fluid channel 18.

The drill bit according to the present invention has numerous advantages. By having the orifices of the fluid channels positioned centrally the fluid will have to travel a relative long distance passing through the grooves 21, 22. This means that flushing of the front surface 24 will be more efficient. By having a cavity 27 around the buttons 13-15 the latter will be more easily reground since not much steel needs to be removed during grinding of these buttons. This is true to some extent also for the buttons 12. The orifices of the fluid channels 16-18 are sunk relative to the raised portion 28 such that these orifices will not easily be clogged or deformed. The relative symmetry of the front surface makes the front surface suitable for drill bits for left hand and right hand drilling which is the case at top hammer and down-the-hole drilling, respectively. At tests the life of the drill bit according to the present invention has been extended from 500 m of conventional bits to 600 m, i.e. a life increase of 20%.

The invention claimed is:

1. A rock drill bit adapted for percussive drilling, the drill bit comprising:

a bit body;

a head portion defining a longitudinal center axis, the head portion comprising a front face having an outer surface portion, and an inner surface portion disposed radially inside of the outer surface portion, the inner surface portion being partially recessed by a cavity with respect to the outer surface portion, and a plurality of fluid channels extending through the head portion and communicating with the cavity for conducting a flushing medium thereto, wherein the inner surface portion comprises a raised portion carrying a plurality of buttons, wherein an imaginary circle intersecting centers of the fluid channels also intersects an equal number of buttons, and wherein the cavity on the front face of the head portion radially extends in at least one radial direction to end at a peripheral groove in the bit body.

2. The rock drill bit according to claim 1, wherein a plurality of peripheral buttons are mounted in the head portion radially outside of the outer surface portion and arranged generally annularly around a longitudinal axis of the drill bit, and wherein a plurality of front buttons are mounted in the front face radially inside of the peripheral buttons.

3. The rock drill bit according to claim 2, wherein six front buttons are mounted in the front face radially outside of the circle.

4. The rock drill bit according to claim 2, characterized in that nine peripheral buttons are mounted in the front face radially outside of the circle.

5. The rock drill bit according to claim 1, wherein retrac teeth are positioned at a maximum diameter of the drill bit, as well as inside of the same, at an end generally facing away from the front face of the rock drill bit.

6. A rock drill bit adapted for percussive drilling, the drill bit comprising:

a bit body;

a head portion defining a longitudinal center axis, the head portion comprising a front face having an outer surface portion, and an inner surface portion disposed radially inside of the outer surface portion, the inner surface portion being partially recessed by a cavity with respect to the outer surface portion, and a plurality of fluid channels extending through the head portion and communicating with the cavity for conducting a flushing medium thereto, wherein the inner surface portion comprises a raised portion carrying a plurality of buttons, wherein orifices of the fluid channels are arranged in one plane below the raised portion, and wherein the cavity extends between peripheral grooves in the bit body.

7. The rock drill bit according to claim 6, wherein the cavity on the front face of the head portion radially extends in at least one radial direction to end at a peripheral groove in the bit body.

8. The rock drill bit according to claim 1, wherein a peripheral groove is provided between at least one pair of peripheral buttons in the bit body.

9. The rock drill bit according to claim 1, wherein the raised portion is of generally triangular shape having rounded corner portions comprising buttons.

10. The rock drill bit according to claim 1, wherein the raised portion comprises at least five front buttons, whereof one button intersects the longitudinal center axis.

11. The rock drill bit according to claim 10, wherein the raised portion comprises at least six front buttons.

12. The rock drill bit according to claim 6, wherein a plurality of peripheral buttons are mounted in the head portion radially outside of the outer surface portion and arranged generally annularly around a longitudinal axis of the drill bit, and wherein a plurality of front buttons are mounted in the front face radially inside of the peripheral buttons.

13. The rock drill bit according to claim 12, wherein six front buttons are mounted in the front face radially outside of the circle.

14. The rock drill bit according to claim 12, characterized in that nine peripheral buttons are mounted in the front face radially outside of the circle.

15. The rock drill bit according to claim 6, wherein a peripheral groove is provided between at least one pair of peripheral buttons in the bit body.

16. The rock drill bit according to claim 6, wherein the raised portion is of generally triangular shape having rounded corner portions comprising buttons.

17. The rock drill bit according to claim 6, wherein the raised portion comprises at least five front buttons, whereof one button intersects the longitudinal center axis.

18. The rock drill bit according to claim 17, wherein the raised portion comprises at least six front buttons.

19. The rock drill bit according to claim 6, wherein retrac teeth are positioned at a maximum diameter of the drill bit, as well as inside of the same, at an end generally facing away from the front face of the rock drill bit.

* * * * *